US005875970A

United States Patent [19]

Guo

[11] Patent Number: 5,875,970

[45] Date of Patent: Mar. 2, 1999

[54] SPRINKLER HAVING VARYING WATER OUTLET

[76] Inventor: Wen Li Guo, No. 10, Fang Dong Road, Wen Gin Tsuen, Fang Yuan Hsiang, Chang Hua Hsien, Taiwan

[21] Appl. No.: 843,778

[22] Filed: Apr. 21, 1997

[51] Int. Cl.[6] ..... B05B 7/12

[52] U.S. Cl. ..... 239/240; 239/583

[58] Field of Search ..... 239/240, 583, 239/237, 263; 251/252, 259, 255

[56] References Cited

U.S. PATENT DOCUMENTS

| | | | |
|---|---|---|---|
| 1,307,634 | 6/1919 | Morse | 239/240 X |
| 1,620,315 | 3/1927 | Balcer | 251/252 |
| 3,272,437 | 9/1966 | Coson | 239/240 X |
| 3,790,082 | 2/1974 | Pochard | 239/240 |
| 4,252,278 | 2/1981 | McMillan | 239/583 |
| 4,277,029 | 7/1981 | Rabitsch | 239/240 X |
| 4,534,510 | 8/1985 | Rinkewich | 239/240 X |
| 4,662,565 | 5/1987 | Waldrum | 239/240 X |
| 4,982,897 | 1/1991 | Matusita et al. | 239/583 X |

*Primary Examiner*—Kevin Weldon

[57] ABSTRACT

A sprinkler includes a housing having a water inlet and a water outlet. A plug is slidably secured in the housing and may be moved toward and away from the water outlet for adjusting outlet water quantity. A block is rotatably supported in the housing and has a helical groove for engaging with the plug and for moving the plug forward and rearward relative to the water outlet. The water outlet quantity may thus be adjusted for allowing much water to sprinkle the farther area and for allowing less water to sprinkle the closer area to the sprinkler.

2 Claims, 3 Drawing Sheets

SPRINKLER HAVING VARYING WATER OUTLET

BACKGROUND OF THE INVENTION

1. Field of the Invention

The present invention relates to a sprinkler, and more particularly to a sprinkler having varying or changing water outlet.

2. Description of the Prior Art

Typical sprinklers comprise a water outlet which may be rotated for allowing the outlet water to sprinkle for a wider range. The distal area to the sprinkler normally covers a wider range or area and requires much more water for sprinkling the whole area, and the area closer to the sprinkler normally covers a less range or area and requires less water for sprinkling the closer area. However, the quantity of the outlet water may not be changed or adjusted, such that the distal area may not be supplied with much water and the closer area to the sprinkler may not be supplied with less water.

The present invention has arisen to mitigate and/or obviate the afore-described disadvantages of the conventional sprinklers.

SUMMARY OF THE INVENTION

The primary objective of the present invention is to provide a sprinkler in which the water outlet may be changed and varied.

In accordance with one aspect of the invention, there is provided a sprinkler comprising a housing including a water inlet and a water outlet, a plug slidably secured in the housing and adapted to be moved toward and away from the water outlet, and means for moving the plug toward and away from the water outlet and for adjusting outlet water quantity.

The moving means includes a casing secured in the housing and having a slot, the plug includes a projection slidably engaged in the slot, and means for actuating the projection to move along the slot and for moving the plug to move toward and away from the water outlet.

The actuating means includes a block rotatably supported in the housing, the block includes a helical and endless groove for engaging with the projection and for moving the projection along the slot, and the actuating means includes means for rotating the block.

The rotating means includes a wheel rotatably supported in the housing at a shaft and disposed beside the water inlet for allowing the wheel to be rotated by inlet water, the shaft includes a warm gear, a rod is rotatably supported in the housing and includes a pinion for engaging with the warm gear and for allowing the rod to be rotated by the wheel, the block is secured on the rod for allowing the block to be rotated by the wheel. The wheel is preferably a paddle wheel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 4:
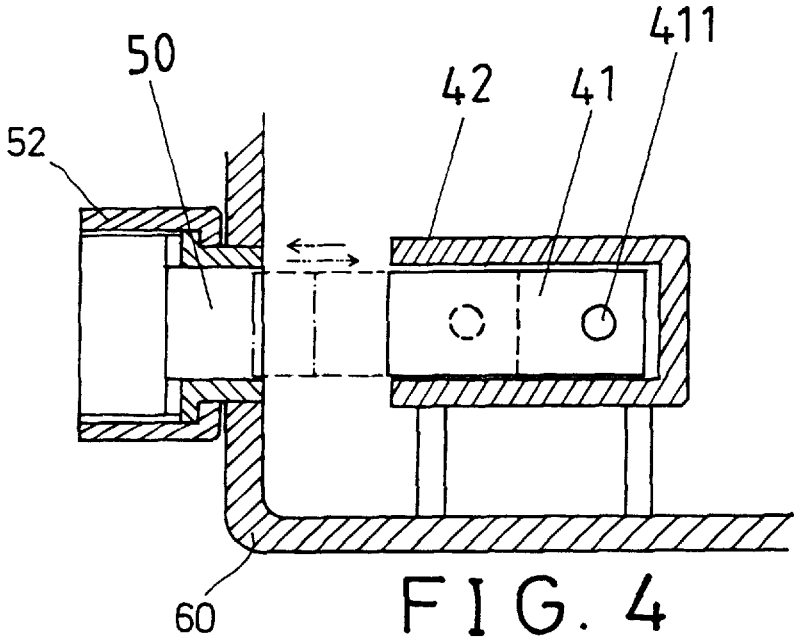
FIG. 4 is a partial cross sectional view illustrating the water outlet portion of the sprinkler.
Figure 2:
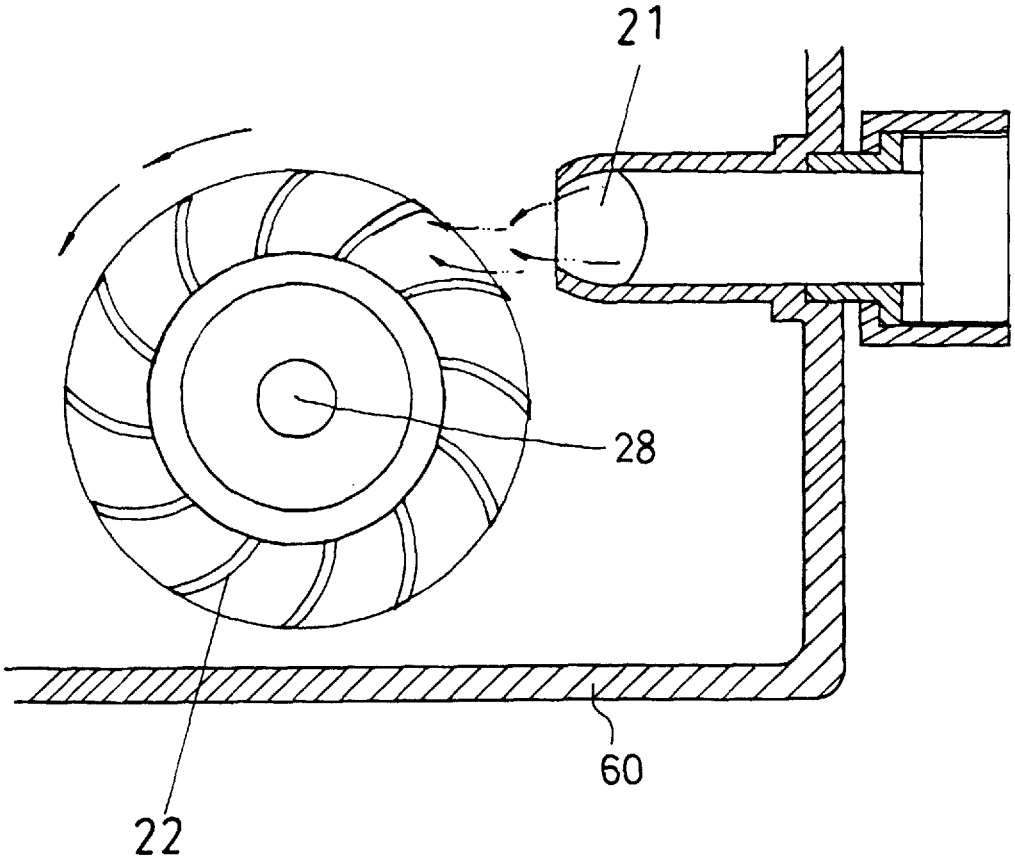
FIG. 2 is a partial cross sectional view illustrating the water inlet portion of the sprinkler.
Figure 3:
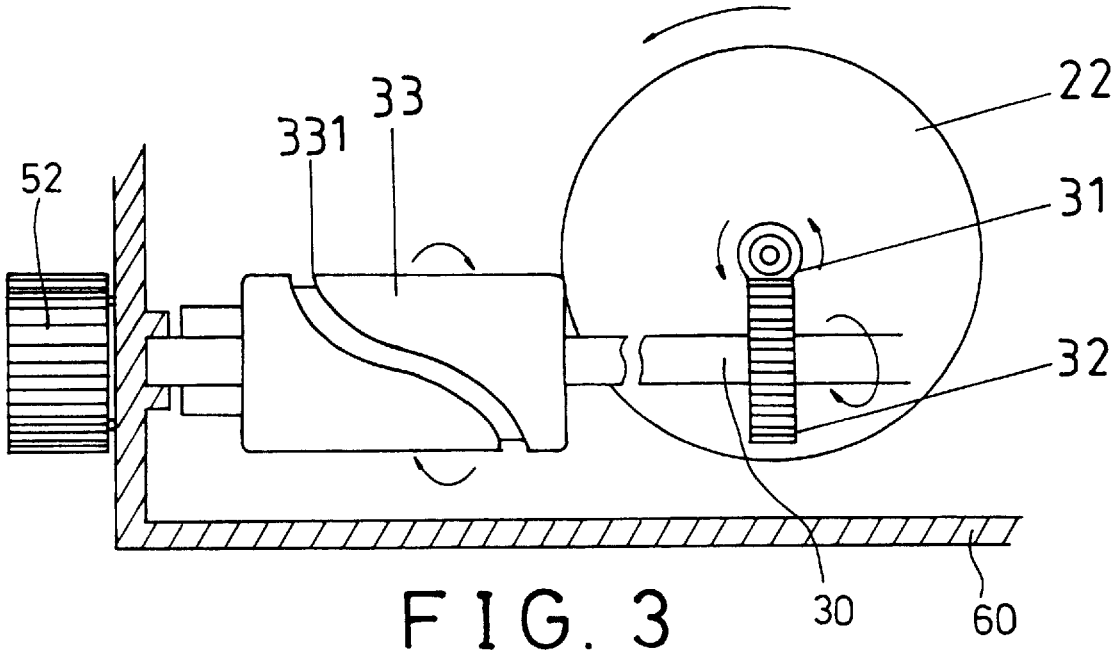
FIG. 3 is a schematic view illustrating the actuating mechanism of the sprinkler.

Referring to the drawings, and initially to FIGS. 1–4, a sprinkler in accordance with the present invention comprises a housing 60 (FIGS. 1 and 6) including a water inlet 21 and a water outlet 50. A wheel, such as a paddle wheel 22 is rotatably secured in the housing 60 at a shaft 28 and is disposed beside the water inlet 21 for allowing the inlet water to rotate the wheel 22 (FIG. 2). The shaft 28 includes a warm gear 31 for engaging with a pinion 32 which is secured on a rod 30. A block 33 is secured on the rod 30 and rotated in concert with the rod 30 and includes a helical and endless groove 331. Both the pinion 33 and the block 33 may be rotated by the wheel 22, best shown in FIG. 3. A casing 42 is secured beside the block 33 and includes a slot 421. A plug 41 is slidably engaged in the casing 42 and includes a projection 411 slidably engaged in the slot 421 and slidably engaged with the groove 331 for allowing the plug 41 to be moved toward and away from the water outlet 50 and for allowing the plug 41 to adjust the quantity of the outlet water through the water outlet 50 (FIG. 4).

Figure 5:
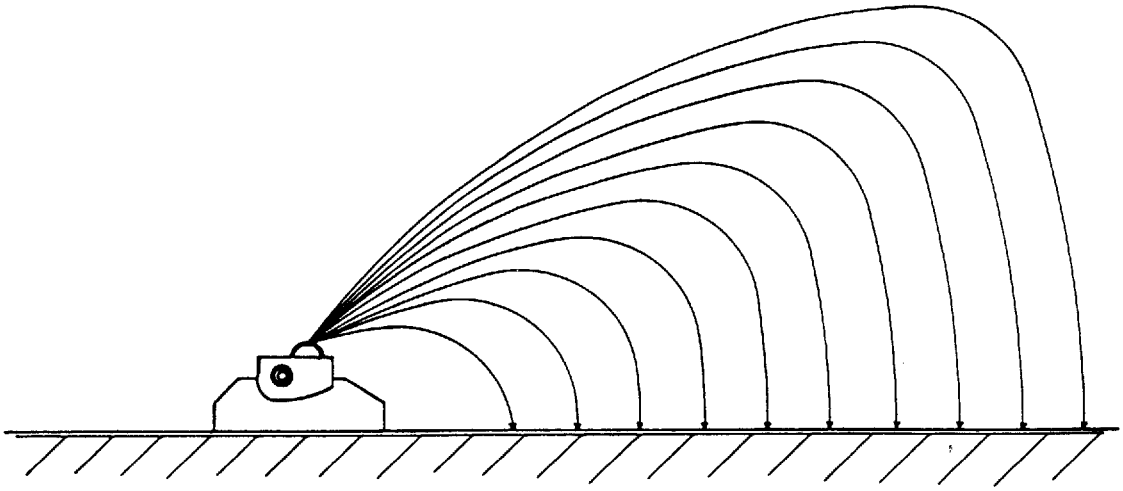
FIG. 5 is a schematic view illustrating the water spraying condition of the sprinkler.
Figure 1:
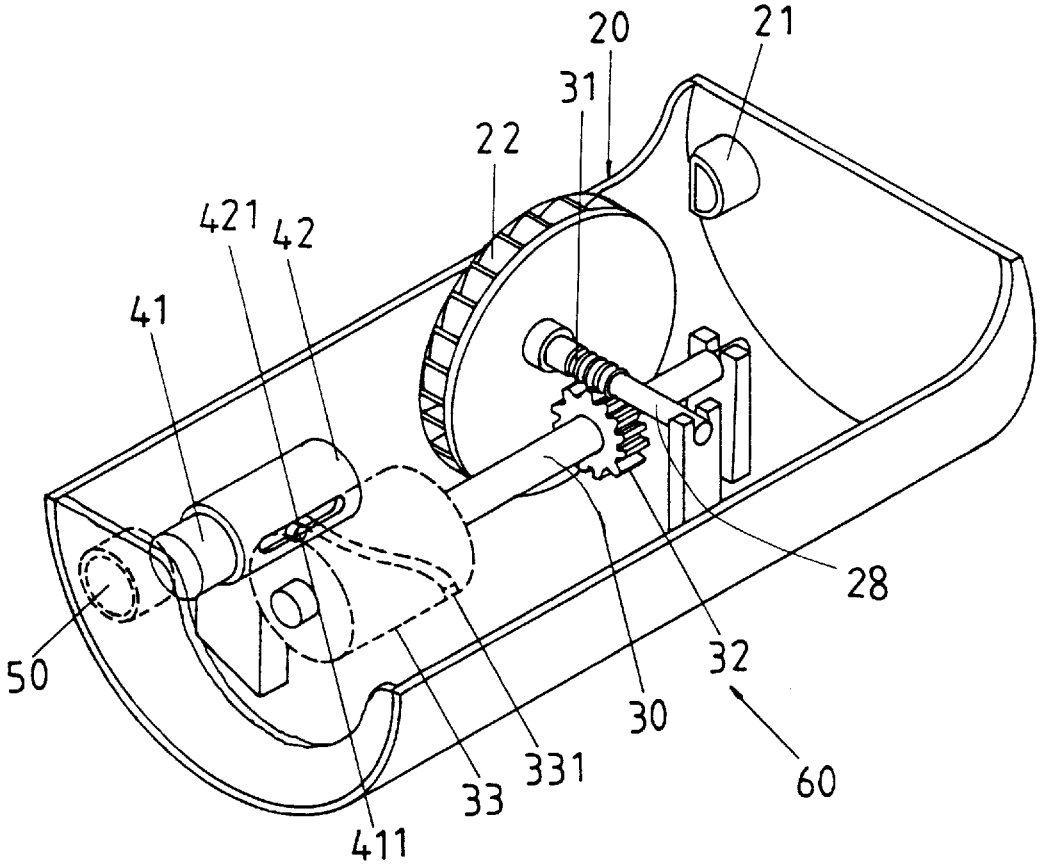
FIG. 1 is a partial perspective view of a sprinkler in accordance with the present invention.

Referring next to FIG. 5, when the plug 41 is moved away from the water outlet 50, the outlet water has the greatest outlet quantity and may thus be sprinkled to the farthest distance. When the plug 41 is moved toward the water outlet 50 in order to block the outlet water, the outlet water thus has reduced outlet quantity and may be sprinkled to the closer area. The water outlet 50 may thus be opened and blocked by the plug 41 so as to adjust the quantity of the outlet water and so as to allow water to sprinkle for a wide range.

Figure 6:
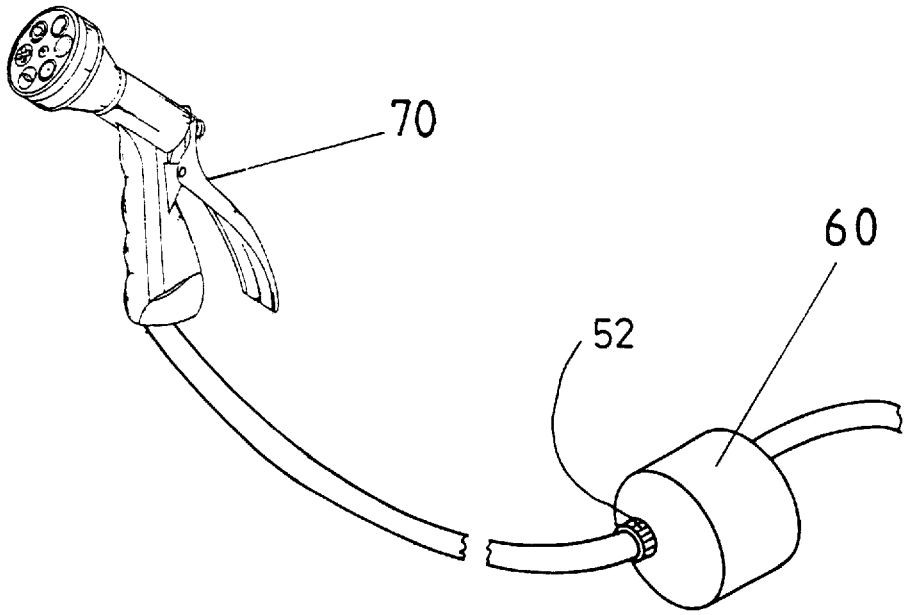
FIG. 6 is a partial perspective view illustrating the application of the sprinkler.

Referring next to FIG. 6, a spray gun 70, for example, may be coupled to the water outlet 50 of the housing 60 by a coupler 52. The water flowing out of the spray gun 70 may also be adjusted or changed by the plug 41.

Accordingly, the sprinkler in accordance with the present invention includes a water outlet that may be changed and varied for sprinkling different areas distal or closer to the sprinkler.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprinkler comprising:

a housing including a water inlet and a water outlet, a wheel rotatably supported in said housing at a shaft and disposed beside said water inlet for allowing said wheel to be rotated by inlet water, a worm gear secured on said shaft, a rod rotatably supported in said housing and including a pinion engaged with said worm gear for allowing said rod to be rotated by said wheel, a casing secured in said housing and having a slot formed therein, a plug slidably secured in said casing and adapted to be moved toward and away from said water outlet, said plug including a projection slidably engaged in said slot, and a block secured on said rod for allowing said block to be rotated by said wheel, said block including a helical and endless groove for slidably receiving said projection and to move said projection along said slot and to and to move said plug toward and away from said water outlet and to adjust an outlet water quantity.

2. The sprinkler according to claim 1, wherein said wheel is a paddle wheel.

* * * * *